United States Patent [19]

Walker

[11] 4,311,069

[45] Jan. 19, 1982

[54] WIRE PULLING HAND TOOL

[75] Inventor: Richard P. Walker, Sagertown, Pa.

[73] Assignee: GTE Products Corporation, Stamford, Conn.

[21] Appl. No.: 161,800

[22] Filed: Jun. 23, 1980

[51] Int. Cl.[3] ..... B25B 25/00; B25B 33/00

[52] U.S. Cl. ..... 81/3 J; 254/18; 254/245; 254/246; 254/250

[58] Field of Search ..... 140/123, 123.5; 254/18, 254/29 A, 245–247, 250–254; 81/3 J

[56] References Cited

U.S. PATENT DOCUMENTS

| | | | |
|---|---|---|---|
| 1,309,634 | 7/1919 | Kelley | 254/29 A |
| 1,314,072 | 8/1919 | Ensteness | 81/3 J |
| 2,735,649 | 2/1956 | Swallert | 254/18 |

*Primary Examiner*—Howard N. Goldberg
*Assistant Examiner*—Fred A. Silverberg
*Attorney, Agent, or Firm*—Thomas H. Buffton

[57] ABSTRACT

A hand tool for pulling a single wire or contact into a connector block includes a thumb lever for effecting a gripping action on the wire or contact and a trigger member for moving an outer holder and sleeve with respect to an inner holder and sleeve whereby gripping of the wire is independent of the movement between wire and connector block.

10 Claims, 5 Drawing Figures

WIRE PULLING HAND TOOL

TECHNICAL FIELD

This invention relates to a hand tool for pulling a wire with respect to a block and more particularly to a hand tool for inserting a single wire within a connector block.

BACKGROUND ART

In the field of connectors wherein a plurality of press-fit contacts are disposed within an insulator or connector block, it is not uncommon to find one of the contacts missing or deformed during manufacture whereupon replacement is necessary. Also, connectors already in use are ordinarily soldered into existing electronic equipment and a major and costly disassembly of the equipment would be required to repair defective or damaged contacts. Thus, replacement of a single press-fit contact or perhaps several contacts becomes highly desirable in apparatus employing connector blocks.

Presently, it is a common practice to grip a single contact with a pair of pliers and to pull on the contact until what appears to be a satisfactory positional location thereof within the connector block is achieved. Also, collet-type tools are available for gripping the contact and pulling until the contact is seated in the connector.

However, a problem associated with the above-mentioned pliers and collet-type tools is the fact that the tool is pulling as the grip on the contact is tightened. Such a condition, has a tendency to cause undesired blemishes on the contact as well as inconsistency in depth of the contact within the connector block. Moreover, there is a tendency for slippage of the tool since the grip on the contact tightens as pulling force is increased.

SUMMARY OF THE INVENTION

In one aspect of the present invention, a single-pin pulling hand tool provides a means for gripping a single wire, a means for moving the wire a given distance in a direction opposite that of a block while maintaining the original grip on the wire, and a means for releasing the grip on the wire after the wire has been seated in the block.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
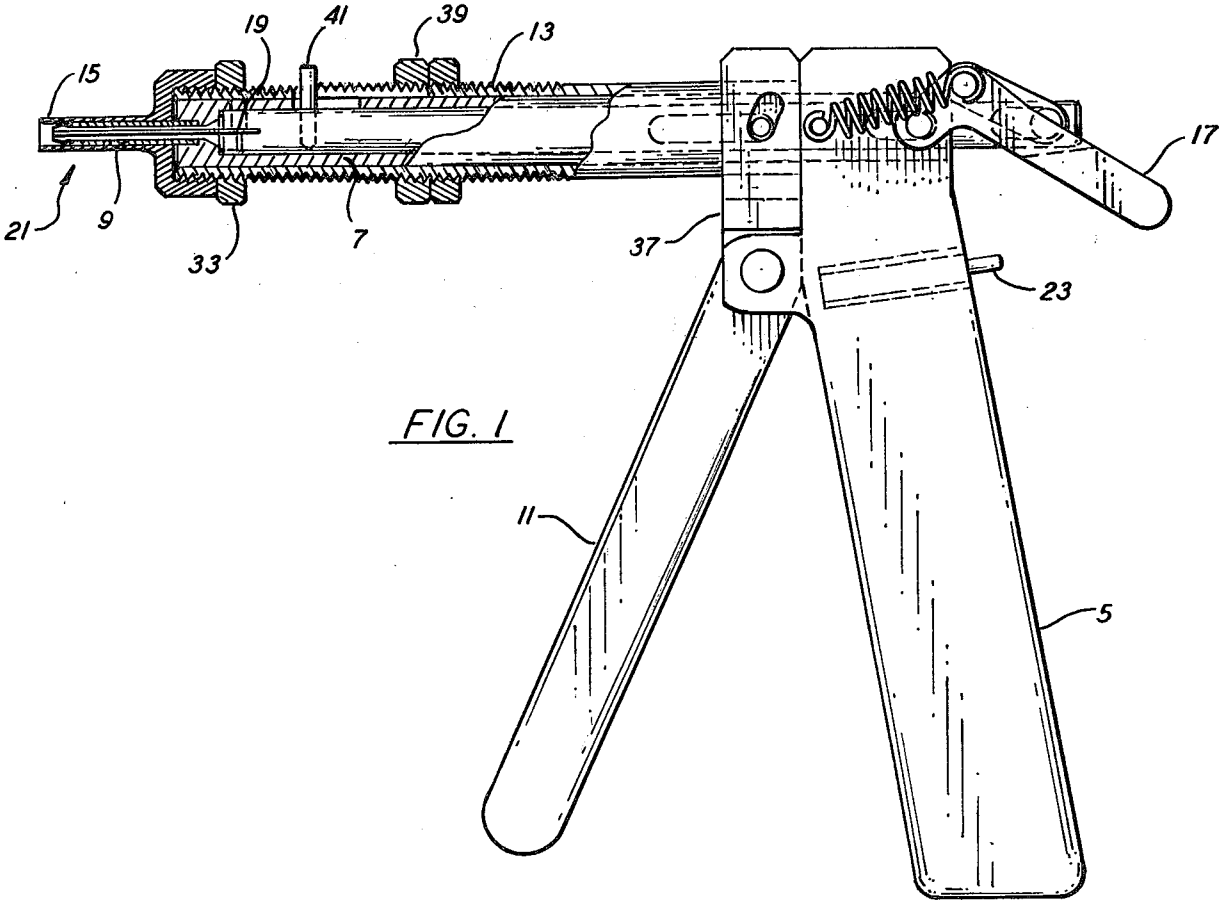
FIG. 1 is an elevational view of one embodiment of a single pin pulling hand tool.

Referring to the drawings, FIG. 1 illustrates a single-pin pulling hand tool having a handle 5 attached to a fixed inner sleeve holder 7 connected to an inner sleeve

9. A trigger member 11 is pivotaly affixed to the handle 5 and connected to a movable outer sleeve holder 13 adjustably connected to an outer sleeve 15. A spring-loaded thumb lever 17 is pivotally attached to the handle 5 and connected to the blade 19 of a collet means 21. Also, a pin member 23 is disposed within the handle 5 and responsive to the trigger member 11 to effect movement of the thumb lever 17.

Figures 1A, 2:
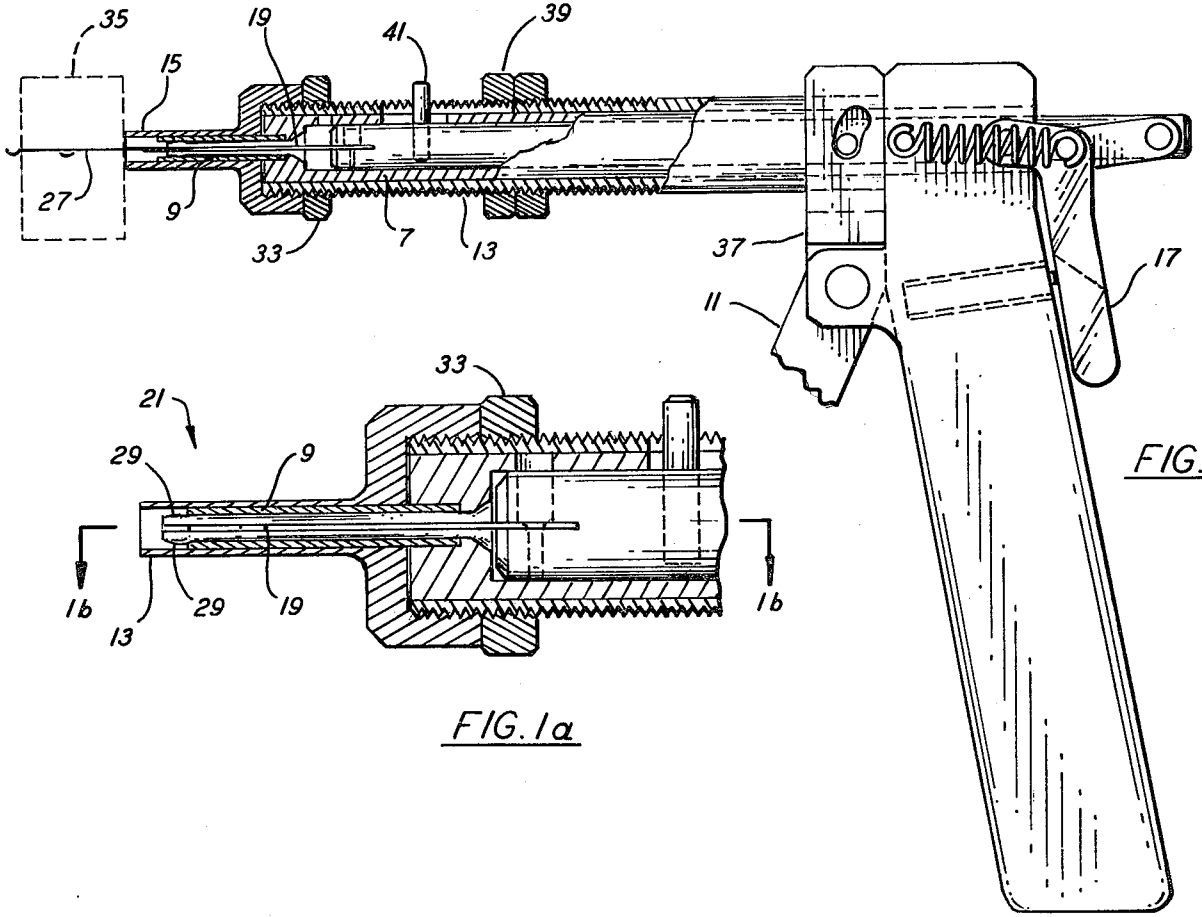
FIGS. 1A and 1B are exploded elevational and plan views of the wire gripping mechanism of the embodiment of FIG. 1.
FIG. 2 illustrates the embodiment of FIG. 1 upon securing the wire within the hand tool.
Figures 1B, 3:
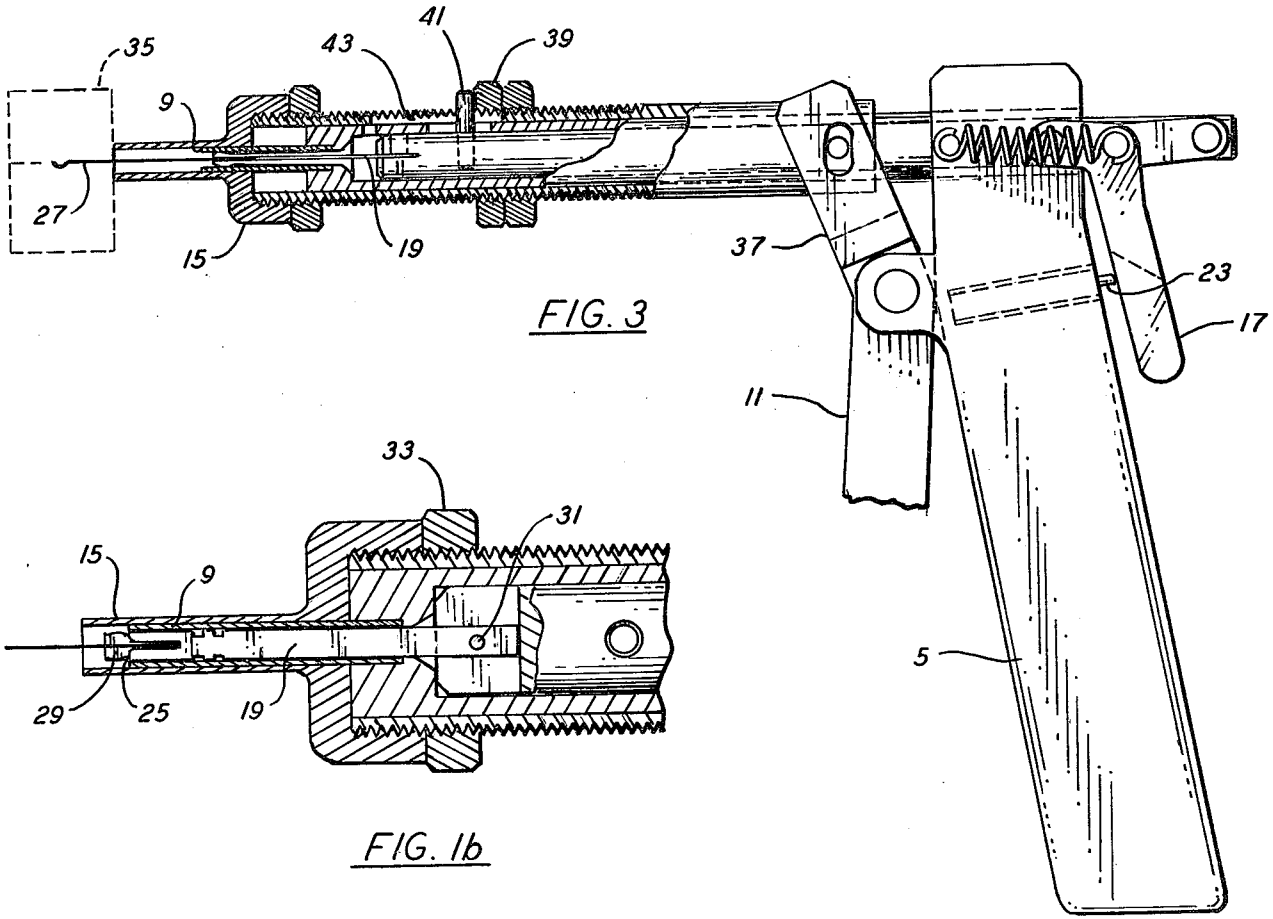
FIG. 3 illustrates the embodiment of FIG. 1 upon movement of the wire and block with respect to one another.

As can be more clearly seen in the exploded views of FIGS. 1*a* and 1*b*, the collet means 21 includes a blade 19 having a bifurcated portion 25 at one end for receiving a wire 27 and a pair of oppositely disposed wire holding members 29 affixed to the blade 19 and formed to grip the wire 27 upon entering the inner sleeve 9. The opposite end of the blade 19 includes a pin receiving aperture 31 whereby connection of the blade 19 to the thumb lever 17 is effected. Also, an adjustable screw arrangement 33 provides for selection of the positional location of the outer sleeve 13 with respect to the inner sleeve 9 and therefor the gripping location on the wire.

FIG. 2 illustrates the hand tool in a wire gripping condition. Therein, the thumb lever 17 has been depressed causing the blade 19 and the wire holding members 29 to move into the inner sleeve 9. In this manner, the wire 27 is securely held by the wire holdings members 29 because of the pressure exerted upon the wire holding members 29 by the inner sleeve 9. Moreover, the positional location of the wire 27 with respect to a connector block 35 as well as the pressure exerted on the wire 27 by the wire holding members 29 remains substantially constant until movement of the wire 27 with respect to the connector block 35 is desired.

As can be seen in FIG. 3, movement of the wire 27 with respect to the connector block 35 is effected by activation of the trigger member 11 after the thumb lever 17 has been depressed and the wire 27 gripped by the collet means 21. Thereupon, squeezing of the trigger member 11 causes a cam member 37 to move the outer sleeve holder 13 and outer sleeve 15 and the connector block 35 with respect to the wire 27, the collet means 21, the inner sleeve 9 and inner sleeve holder 7, and the handle 5.

Further, a hand operable adjustment member 39 in conjunction with a fixed pin 41 disposed within a slot 43 of the outer sleeve holder 13 provides control over the movement of the wire 27 with respect to the connector block 35. Thus, selected positioning of the adjustment member 39 pre-determines the distance the outer sleeve holder 13 will travel with respect to the fixed pin 41 and the distance the wire 27 and connector block 35 will travel with respect to one another. Moreover, it is to be noted that the grip on the wire 27 by the collet means 21 remains substantially constant and independent of the movement between the wire 27 and the connector block 35.

Additionally, removal of pressure on the thumb lever 17 causes movement thereof above the center-line and further movement thereof due to the spring-loading effect. Thereupon, the holding force exerted on the blade 19 is released and the increased movement of the trigger member 11 causes the cam member 37 to advance outer sleeve holder 13 and outer sleeve 15, the connector block 35, and the wire 27. In turn, the collet means 21 exits from the inner sleeve 9 whereupon the grip on the wire 27 by the wire holding members 29 is released.

While there has been shown and described what is at present considered the preferred embodiment of the invention, it will be obvious to those skilled in the art that various changes and modifications may be made therein without departing from the invention as defined by the appended claims.

INDUSTRIAL APPLICABILITY

A hand tool has been provided for effecting insertion of a single wire into a block and more especially for inserting a connector pin into a connector block. The hand tool provides independently operable gripping and movement means for the single wire whereby the grip upon the wire remains unchanged regardless of the distance the wire and connector block are moved with respect to one another.

I claim:

1. In a hand tool for effecting movement of a wire and block with respect to one another including a handle connected to an inner sleeve holder and attached inner sleeve and an outer sleeve holder and outer sleeve telescoped over and movable with respect to the inner sleeve holder and said inner sleeve, the improvement comprising:

collet means formed to receive and grip said wire; lever means for activating said collet means to effect gripping of said wire; and trigger means responsive to initial pressure with respect to said handle to effect movement between said inner sleeve holder, said inner sleeve, said wire, and said outer sleeve holder, said outer sleeve, and said block to cause said block to move with respect to said wire and upon added pressure on said trigger means to cause said lever means to release said collet means and said gripping of said wire and to move said block, said outer sleeve holder, said outer sleeve, said wire with respect to said inner sleeve holder and said inner sleeve whereby said wire is gripped, moved with respect to said block, and released.

2. The hand tool of claim 1 wherein said collet means is in the form of a slotted blade formed to receive said wire within said slot and a pair of oppositely disposed wire gripping members.

3. The hand tool of claim 1 wherein said outer sleeve holder and said outer sleeve are adjustable with respect to said collet means whereby wire gripping length is alterable.

4. The hand tool of claim 1 wherein the movement distance of said outer sleeve holder and said outer sleeve with respect to said inner sleeve holder and said inner sleeve is adjustable.

5. The hand tool of claim 1 wherein said lever means for gripping and releasing said wire is separate from said trigger means for effecting movement of said wire with respect to said block.

6. In a hand tool for inserting a wire into a connector block and having an inner sleeve and inner sleeve holder affixed to a handle with a telescoping outer sleeve and outer sleeve holder movable with respect to the handle, said inner sleeve and said inner sleeve holder, the improvement comprising:

a collet means having a slotted strip for receiving the wire and a pair of oppositely disposed wire gripping members immediately adjacent said slotted strip and said inner sleeve;

a lever means coupled to said slotted strip to effect entrance and exit of said wire gripping members from said inner sleeve whereby gripping and release of said wire is effected; and trigger means associated with said handle and responsive to initial pressure therebetween to cause said connector block and said wire to move in directions opposite to one another and to added pressure to cause said connector block and said wire to move in the same direction.

7. The hand tool of claim 6 wherein movement of said connector block, said outer sleeve holder and said outer sleeve with respect to said wire, said inner sleeve holder and said inner sleeve is effected by said trigger means.

8. The hand tool of claim 6 wherein a first adjustment means provides alteration of said outer sleeve and outer sleeve holder.

9. The hand tool of claim 6 including a second adjustment means of said outer sleeve holder to provide control of the movement distance between said connector block and said wire.

10. The hand tool of claim 6 wherein said handle includes an activating member responsive to added pressure of said trigger means to cause activation of said lever means whereby release of gripping of said wire by said collet means is effected.

* * * * *